US007566846B1

(12) United States Patent
Sorensen et al.

(10) Patent No.: US 7,566,846 B1
(45) Date of Patent: Jul. 28, 2009

(54) MULTI-ZONE BLANKET ARRANGEMENT

(76) Inventors: Cynthia Sorensen, P.O. Box 3147, Quail Valley, CA (US) 92587; Brian Sorensen, P.O. Box 3147, Quail Valley, CA (US) 92587

( * ) Notice: Subject to any disclaimer, the term of this patent is extended or adjusted under 35 U.S.C. 154(b) by 315 days.

(21) Appl. No.: 11/398,896

(22) Filed: Apr. 7, 2006

(51) Int. Cl.
*H05B 1/02* (2006.01)

(52) U.S. Cl. ..... 219/486; 219/508; 219/497; 2/905; 307/39

(58) Field of Classification Search ..... 219/212, 219/505, 501, 506, 483–487, 507–509, 497; 2/83, 905; 307/117, 118, 38–41
See application file for complete search history.

(56) References Cited

U.S. PATENT DOCUMENTS

| | | | | |
|---|---|---|---|---|
| 3,668,367 | A | 6/1972 | Williams | |
| 3,739,142 | A * | 6/1973 | Johns | 219/212 |
| 4,132,262 | A * | 1/1979 | Wibell | 165/206 |
| 4,162,393 | A * | 7/1979 | Balboni | 219/217 |
| 4,659,905 | A | 4/1987 | Gabrosek | |
| 5,036,177 | A * | 7/1991 | Pagliarini, Jr. | 219/212 |
| 5,105,067 | A * | 4/1992 | Brekkestran et al. | 219/497 |
| 5,770,836 | A | 6/1998 | Weiss | |
| 6,768,086 | B2 * | 7/2004 | Sullivan et al. | 219/494 |
| 2003/0234247 | A1 * | 12/2003 | Stern | 219/491 |
| 2004/0026405 | A1 * | 2/2004 | Alvite et al. | 219/486 |
| 2005/0016982 | A1 * | 1/2005 | Campf et al. | 219/212 |

* cited by examiner

*Primary Examiner*—Mark H Paschall

(57) ABSTRACT

A multi-zone blanket includes a body including first heat zones juxtaposed side-by-side and symmetrically aligned within a body cavity. A first primary heating element passes through each of the first heat zones. A first external controller has an AC/DC transformer electrically coupled thereto. The first controller is electrically coupled and removably attached to the first primary heating element. The transformer is removably coupled to an external power supply source which provides a high voltage input to the transformer. The transformer converts the high voltage input to a low voltage input. The first controller includes a mechanism for providing output control signals to the first heat zones such that each first heat zone can simultaneously and independently generate a selected quantity of heat.

9 Claims, 12 Drawing Sheets

MULTI-ZONE BLANKET ARRANGEMENT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to electric blankets and, more particularly, to a multi-zone electric blanket arrangement for distributing alternate levels of heat for a user.

2. Prior Art

Heating pads and electric blankets are appliances that, by their nature, conduct high current electrical power in close proximity to the user. Known electrically heated pads or blankets are arranged to be heated substantially uniformly over the area of the pad or blanket when the electric heating element is energized. It is also known to provide temperature adjusting means in conjunction with electric blankets for allowing a user to select a setting where the generated heat is comfortable to their liking. This is highly effective in instances where one individual is utilizing the blanket. However, when an electric heating blanket is simultaneously utilized by two or more individuals there may be some disagreement on the desired temperature setting preferred by either party.

Heating blankets with multiple heating zones are known in the prior art. One prior art example shows an electric blanket, preferably for a person with arthritis and circulatory problems in their legs, that is provided with a control switch which is located at the top of the blanket for controlling an upper heating element disposed over the body of the person and a lower heating element disposed over the feet of the person so that heat can be supplied in various combinations to the body and feet of the person. Although the blanket is capable of producing more than one temperature zone, the use thereof is still limited to only one person. Furthermore, only two temperature zones are provided, which in certain instances may not provide sufficient versatility for multiple users.

Accordingly, a need remains for a multi-zone electric blanket arrangement in order to overcome the above-noted shortcomings. The present invention satisfies such a need by providing electric blanket that is convenient and easy to use, is durable in design, and provides greater versatility than convention electric heating blankets. Such an electric is produced from a comfortable and soft material that is light and washable. The multi-zone blanket is produced to accommodate all mattress sizes, including single, double, king and queen sized beds. Such a blanket advantageously allows multiple users to simultaneously employ the electric blanket while each user conveniently has their own temperature isolated zone.

BRIEF SUMMARY OF THE INVENTION

In view of the foregoing background, it is therefore an object of the present invention to provide a multi-zone blanket arrangement. These and other objects, features, and advantages of the invention are provided by a multi-zone blanket for distributing alternate levels of heat for a user.

The multi-zone blanket includes a body including a first plurality of heat zones juxtaposed side-by-side within a cavity of the body. Such a first plurality of heat zones are symmetrically aligned within the cavity of the body. The body may further include a second plurality of heat zones that are juxtaposed adjacent to the first plurality of heat zones. The first and second plurality of heat zones are independently and simultaneously operable such that selected portions of the body can conveniently and effectively dissipate alternate heat levels. A first primary heating element passes through each of the first plurality of heat zones.

The present invention further includes a first external controller and an AC/DC transformer electrically coupled directly thereto. Such a first external controller is electrically coupled to the first primary heating element. The first external controller further is removably attached to the first primary heating element. The transformer is removably coupled to an external power supply source which provides a high voltage input to the transformer. Such a transformer converts the high voltage input to a low voltage input in such a manner that the first external controller receives the low voltage input during operating conditions. The first external controller includes a mechanism for providing a plurality of output control signals to the first plurality of heat zones such that each of the first plurality of heat zones can advantageously simultaneously and independently generate a selected quantity of heat as desired by the user.

The multi-zone blanket preferably further includes a second external controller that is electrically coupled to the AC/DC transformer and receives the low input voltage therefrom. Such a second external controller includes a mechanism for providing a plurality of output control signals to the second plurality of heat zones such that each of the second plurality of heat zones can advantageously simultaneously and independently generate a selected quantity of heat as desired by the user. Each of the first and second plurality of heat zones preferably includes a plurality of auxiliary heating elements that are electrically connected to a corresponding one of the primary heating elements. Each of the auxiliary heating elements is connected in parallel to the corresponding primary heating elements respectively.

Each of the output control signal providing mechanisms for the first and second plurality of heat zones may respectively include a user interface for generating and transmitting an input control signal based upon a user input. A processor is electrically coupled to the user interface and receives the input control signal therefrom. A timer circuit is electrically coupled to the processor. A signal interface bus is electrically coupled to the processor for effectively distributing the output control signals to corresponding ones of the first and second plurality of heat zones respectively. A memory is electrically coupled to the processor. Such a memory includes software instructions that cause individual ones of the first and second plurality of heat zones to generate heat for a predetermined period of time and within a predetermined temperature range.

The software instructions execute a control algorithm that includes the steps of identifying a time data stream from the input control signal, identifying a temperature range data stream from the input control signal, identifying whether selected one of the first and second plurality of heat zones are associated with the time and temperature data streams, and instructing the timer circuit to generate and transmit a monitoring output signal to the signal interface bus for controlling distribution of the plurality of output control signals to the corresponding ones of the first and second plurality of heat zones.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
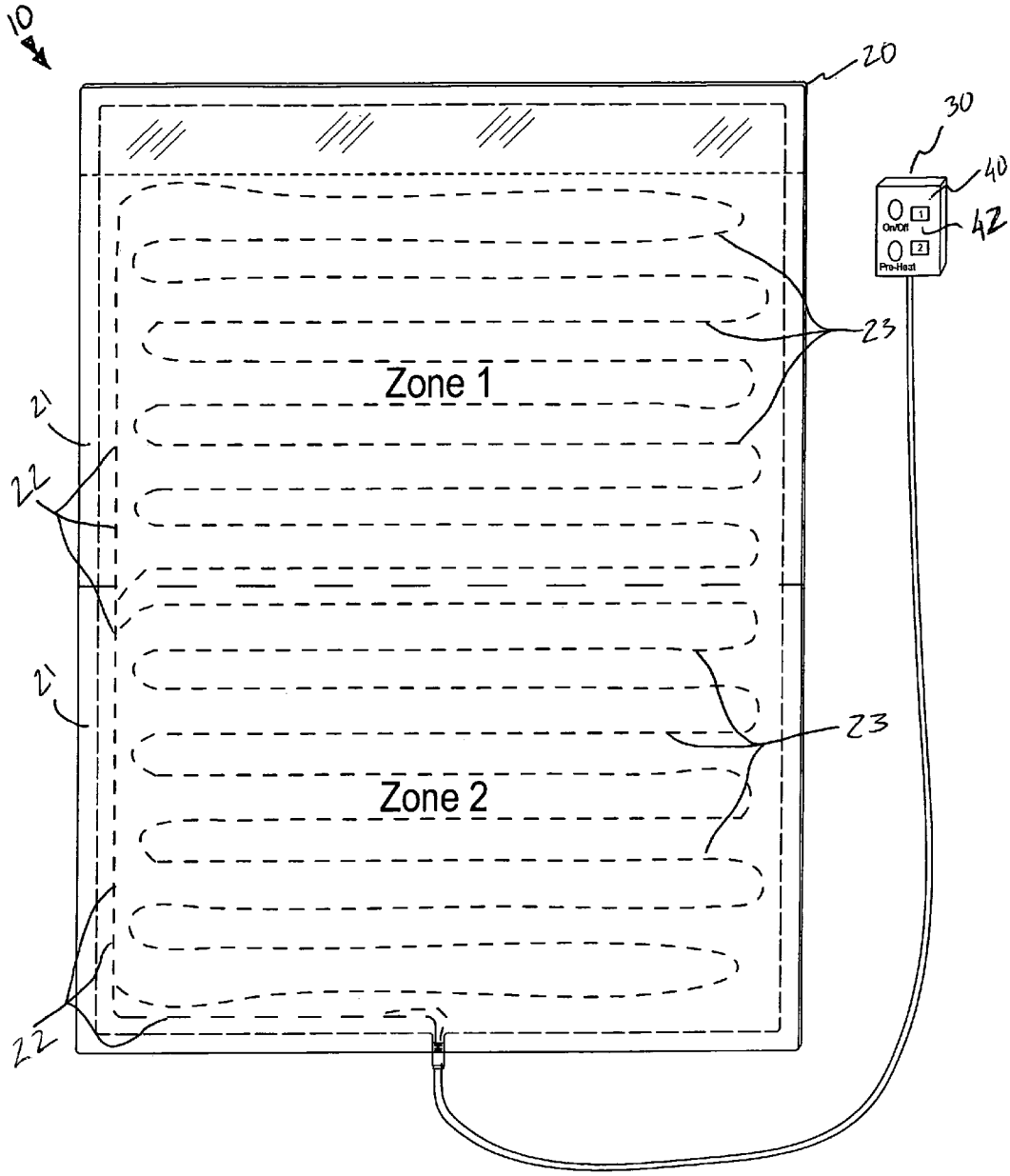
FIG. 1 is a top plan view showing a multi-zone blanket with an alternate heat zone arrangement, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The device of this invention is referred to generally in FIGS. 1-7 by the reference numeral 10 and is intended to provide a multi-zone blanket arrangement. It should be understood that the device 10 may be used to heat many different types of surfaces and should not be limited in use to only blankets.

Figure 1A:
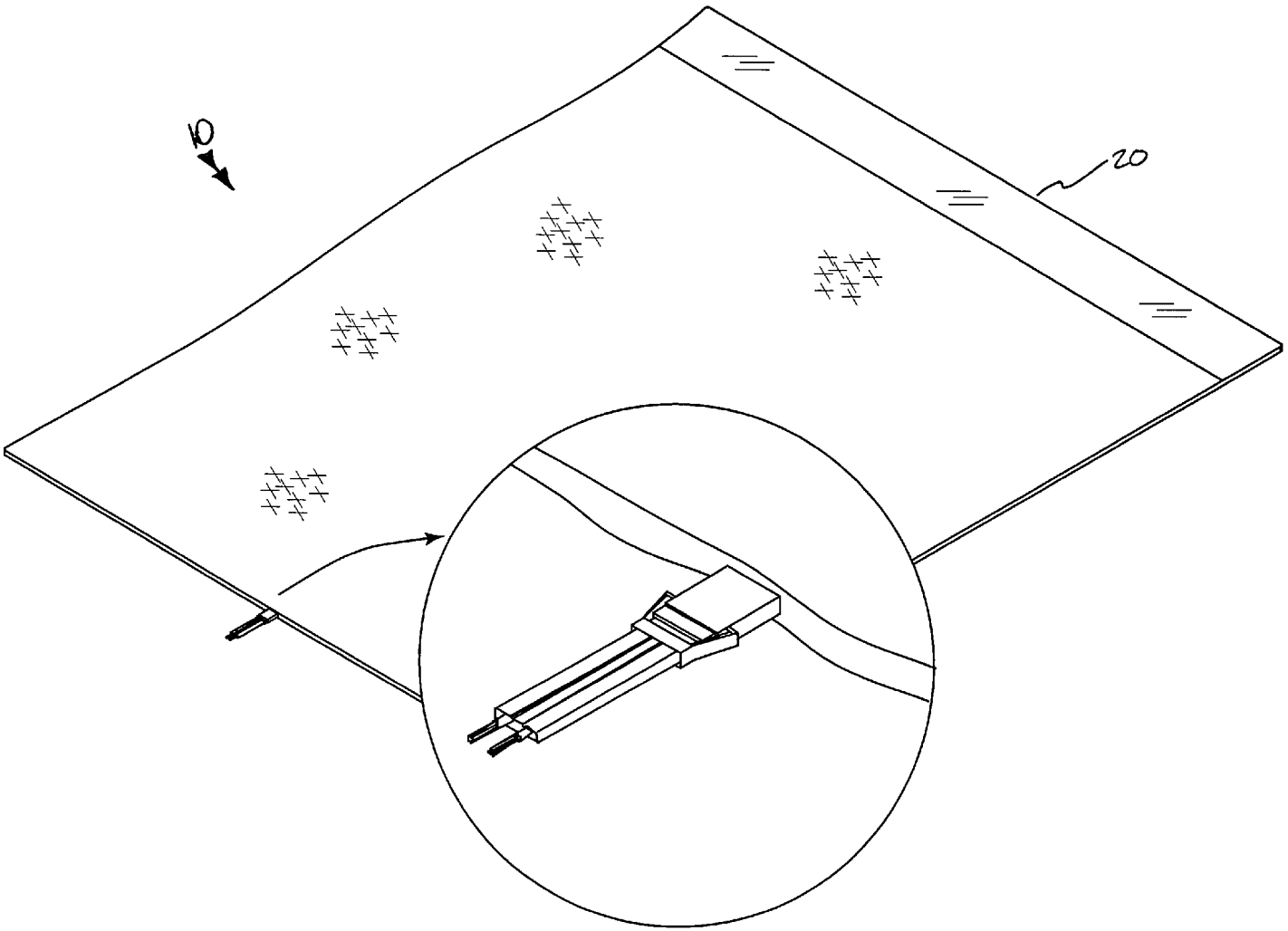
FIG. 1A is a perspective view of the blanket shown in FIG. 1.
Figure 2:
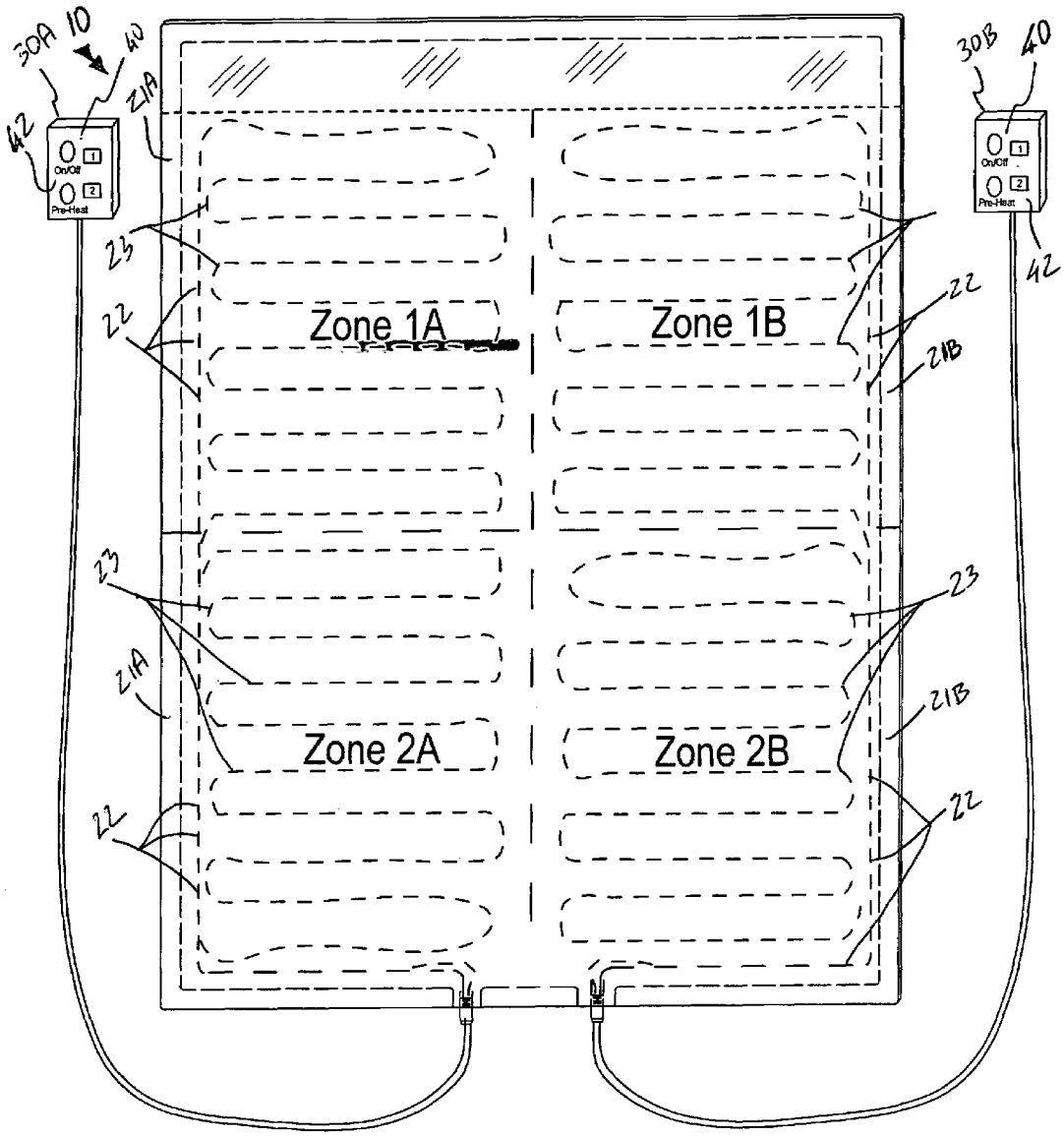
FIG. 2 is a top plan view showing a multi-zone blanket arrangement, in accordance with the present invention.
Figure 5:
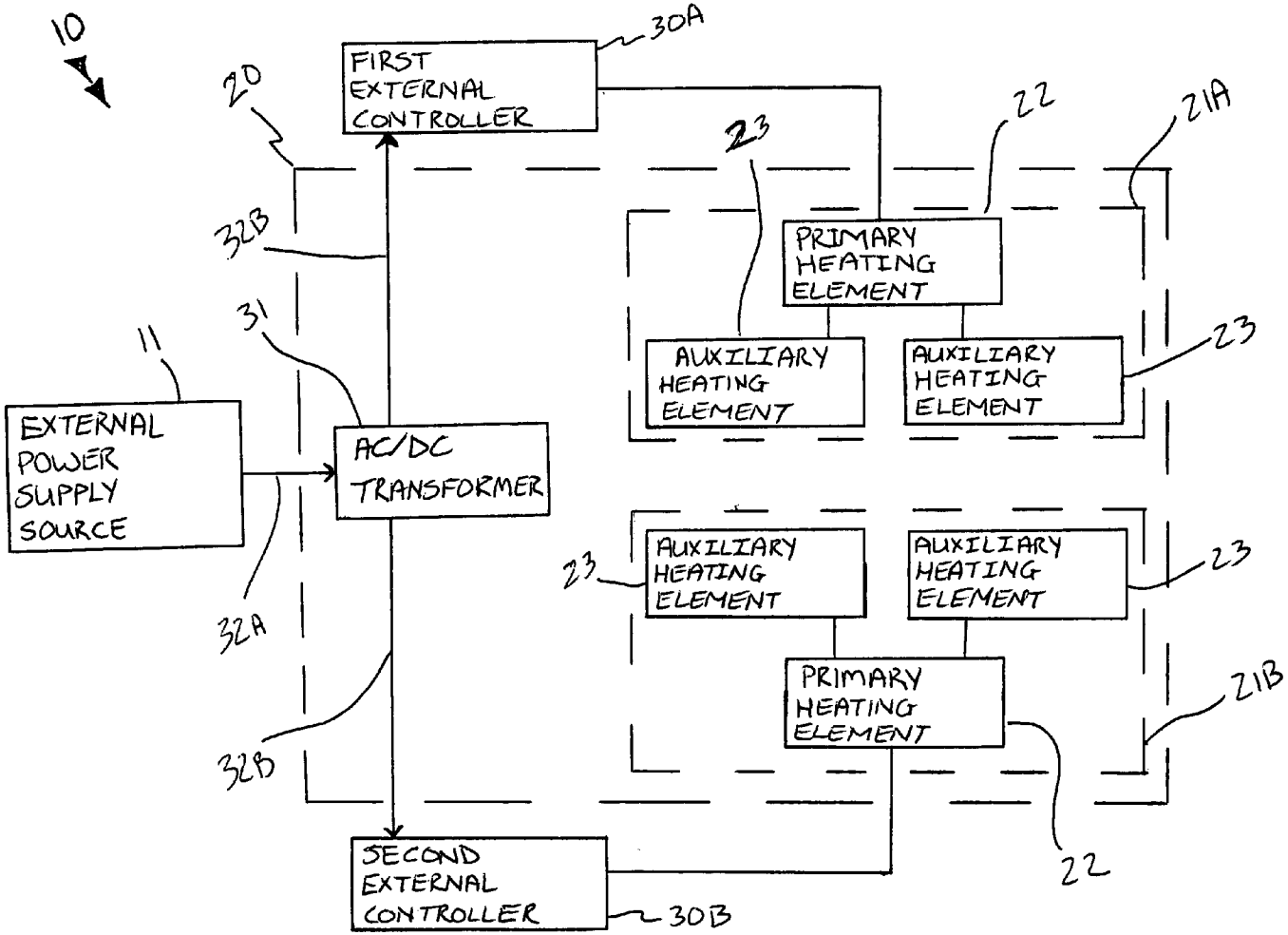
FIG. 5 is a schematic block diagram of the device shown in FIG. 2.

Initially referring to FIGS. 1A, 2 and 5, the device 10 includes a body 20 including a first plurality of heat zones 21A juxtaposed side-by-side within a cavity of the body 20. Such a first plurality of heat zones 21A are symmetrically aligned within the cavity of the body 20. The body 20 further includes a second plurality of heat zones 21B that are juxtaposed adjacent to the first plurality of heat zones 21A. The first 21A and second 21B plurality of heat zones are independently and simultaneously operable, which is essential and advantageous such that selected portions of the body 20 can conveniently and effectively dissipate alternate heat levels. Thus, a person positioned under the first plurality of heat zones 21A can conveniently adjust their temperature setting independently of a person disposed under the second plurality of heat zones 21B. A first primary heating element 22 passes through each of the first plurality of heat zones 21A. Of course, as is shown in FIGS. 1, 3, 3A, 4 and 4A, the body 20 may be include a variety of heating zones for further increasing the versatility thereof, as is obvious to a person of ordinary skill in the art. Auxiliary Referring to FIGS. 1A, 2, 2A, 5 and 6, the present invention further includes a first external controller 30A and an AC/DC transformer 31 electrically coupled directly thereto, without the use of intervening elements. Such a first external controller 30A is electrically coupled to the first primary heating element 22. The first external controller 30A further is removably attached to the first primary heating element 22. The transformer 31 is removably coupled to an external power supply source 11 which provides a high voltage input 32A to the transformer 31. Such a transformer 31 is crucial for converting the high voltage input 32A to a low voltage input 32B in such a manner that the first external controller 30A receives the low voltage input 32B during operating conditions.

The first external controller 30A includes a mechanism 40 for providing a plurality of output control signals 41 to the first plurality of heat zones 21A, which is important such that each of the first plurality of heat zones 21A can advantageously simultaneously and independently generate a selected quantity of heat as desired by the user. Thus, not only can the user alter the temperature from the temperature of a person next to them, but conveniently they can also alter the temperatures among each heat zone in their respective plurality of heat zones.

Figure 2A:
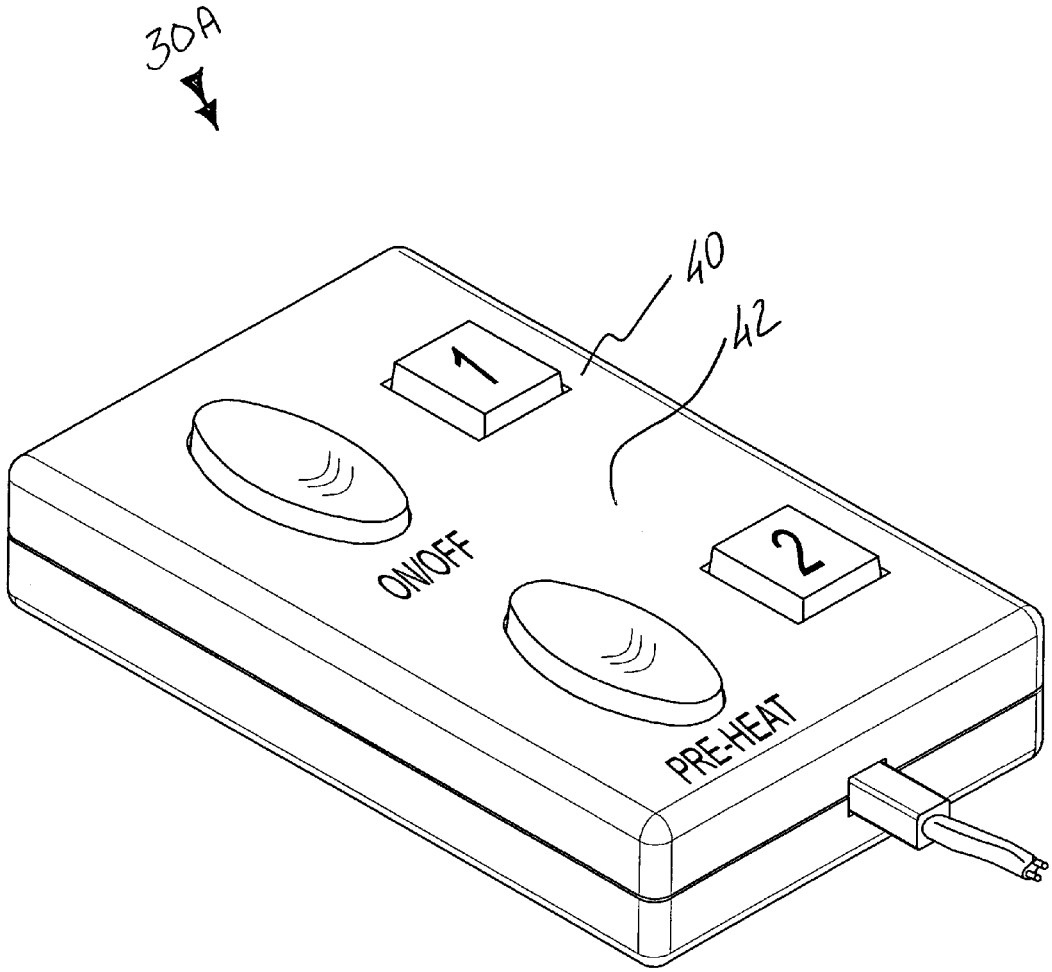
FIG. 2A is perspective view of the controllers shown in FIG. 2.
Figure 3:
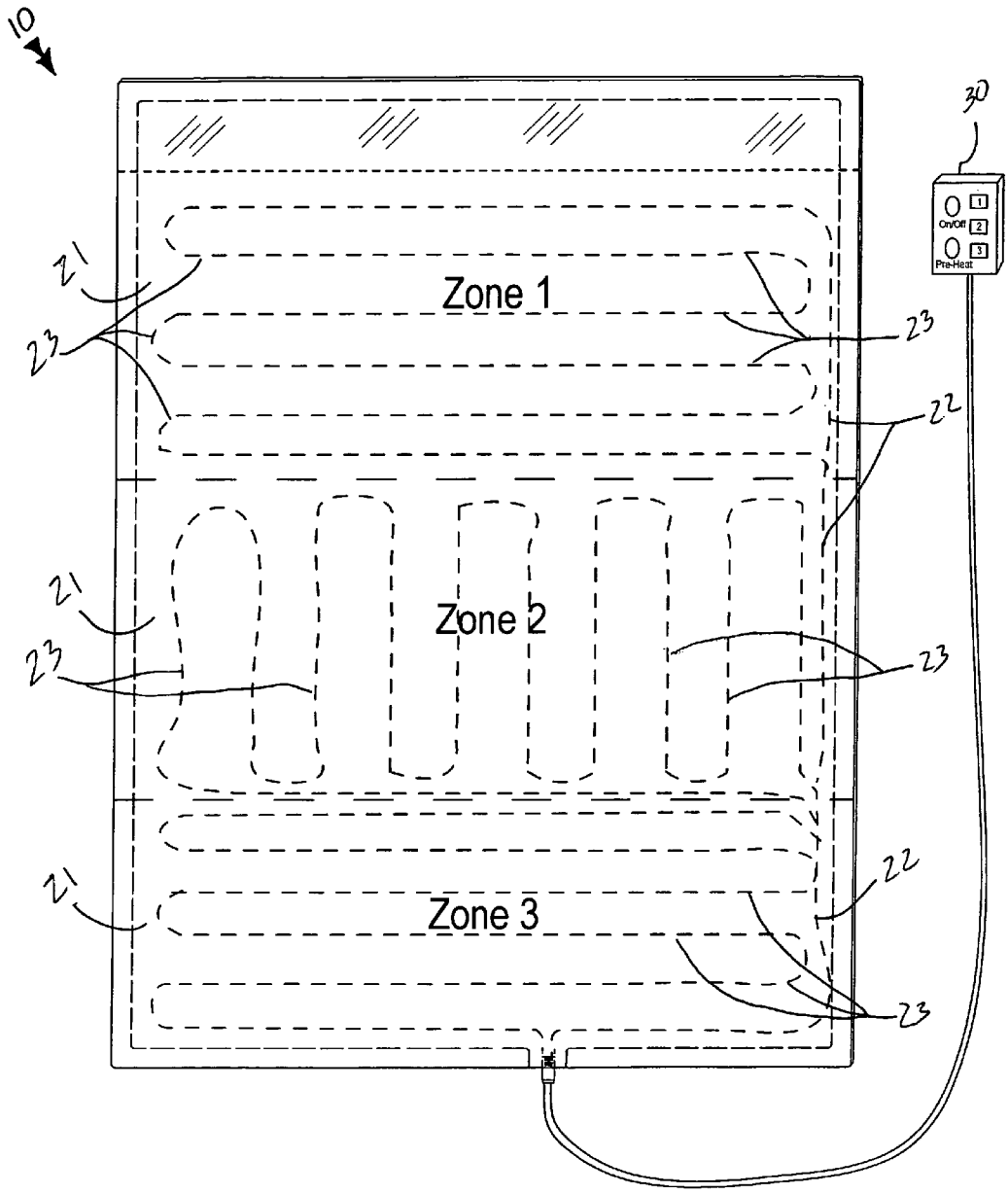
FIG. 3 is a top plan view showing a multi-zone blanket with an alternate heat zone arrangement, in accordance with the present invention.
Figure 3A:
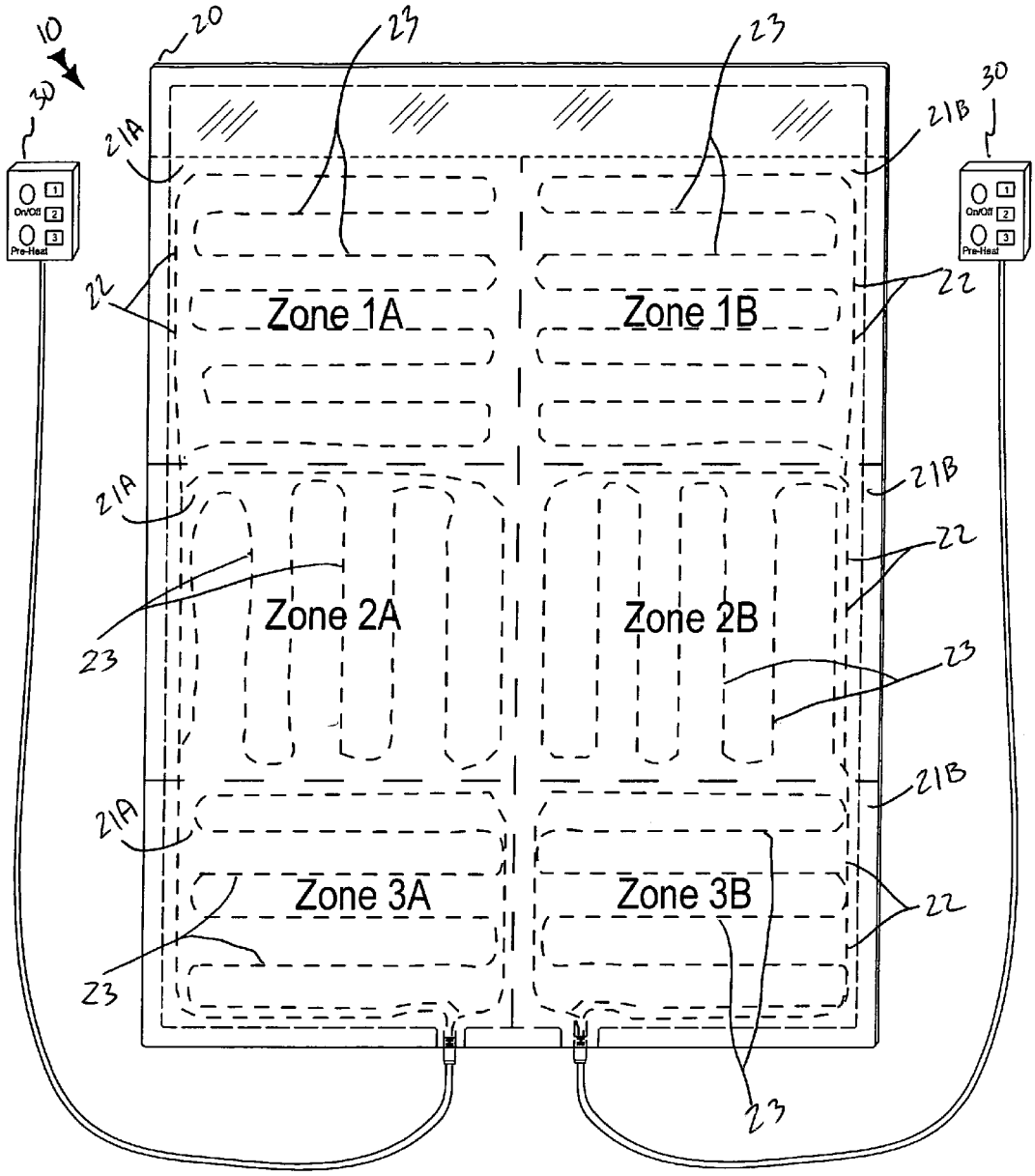
FIG. 3A is a top plan view showing a multi-zone blanket with an alternate heat zone arrangement, in accordance with the present invention.
Figure 3B:
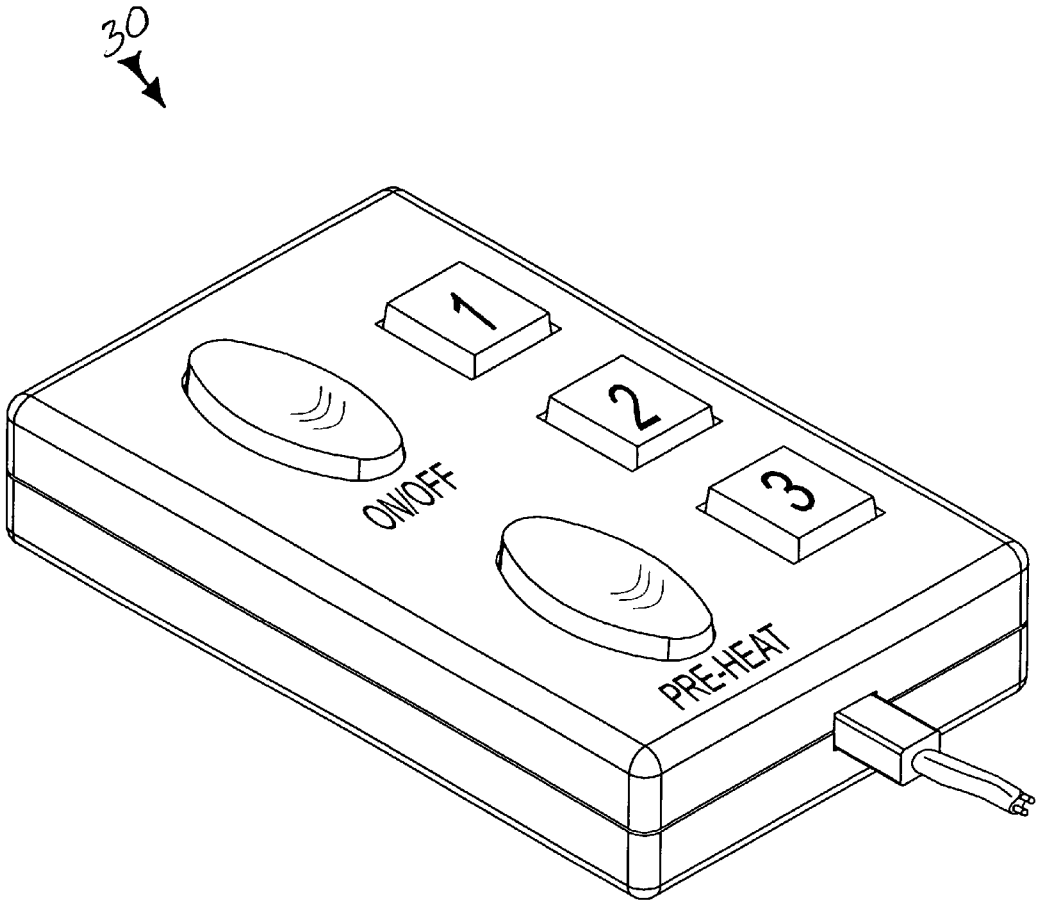
FIG. 3B is a perspective view of the alternate controller interface arrangement, shown in FIGS. 3 and 3A.
Figure 4:
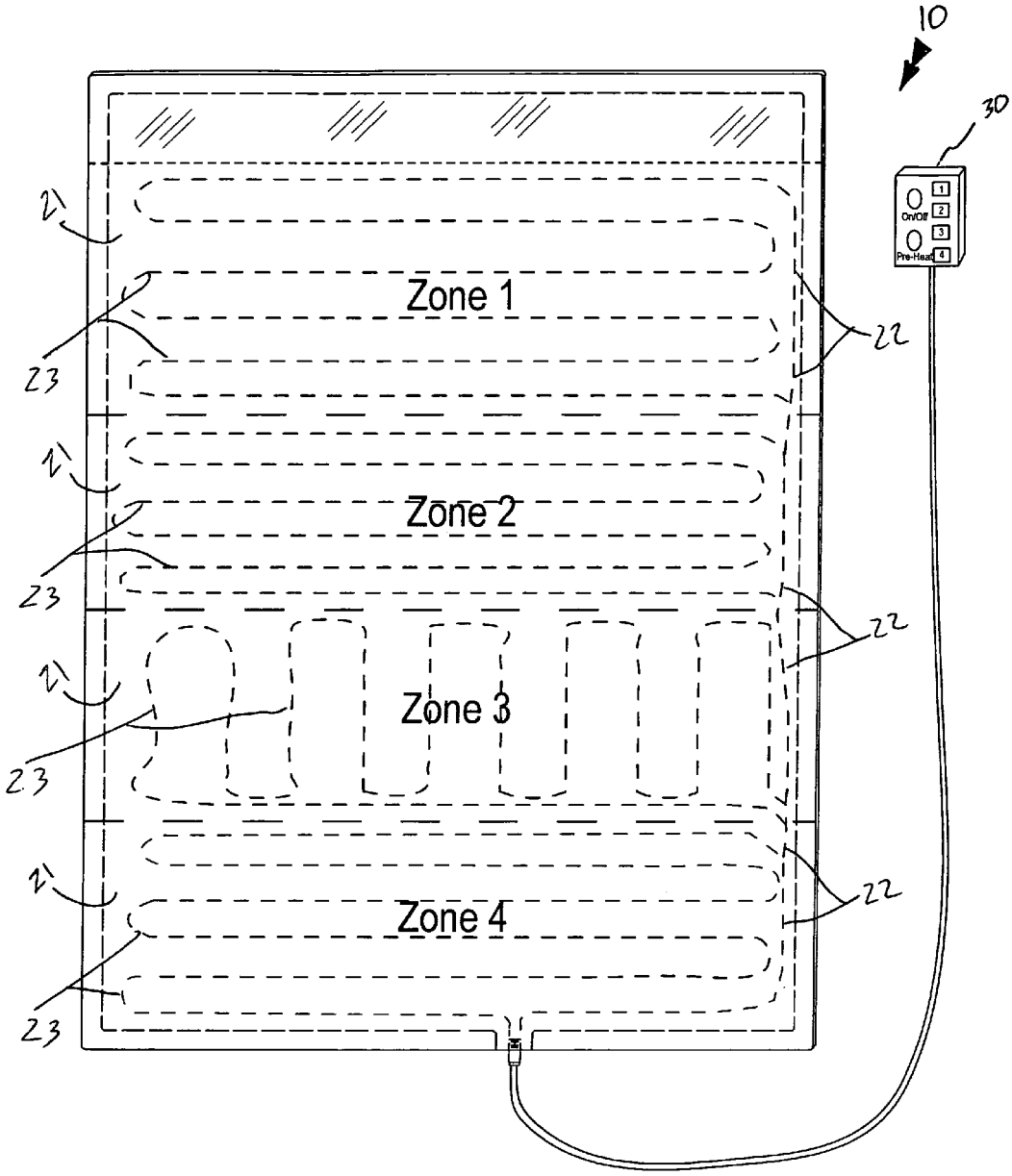
FIG. 4 is a top plan view showing a multi-zone blanket with an alternate heat zone arrangement, in accordance with the present invention.
Figure 4A:
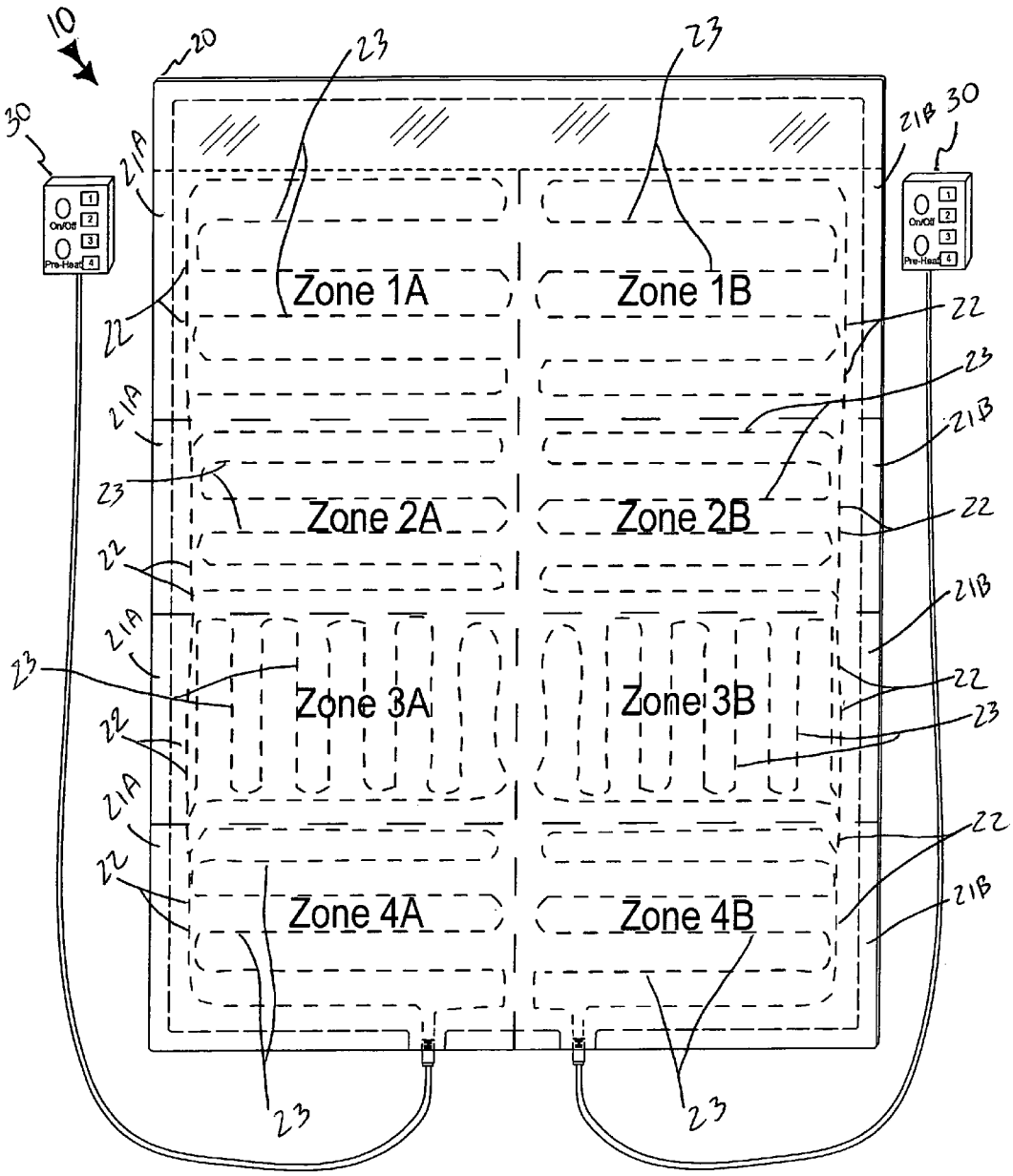
FIG. 4A is a top plan view showing a multi-zone blanket with an alternate heat zone arrangement, in accordance with the present invention.
Figure 4B:
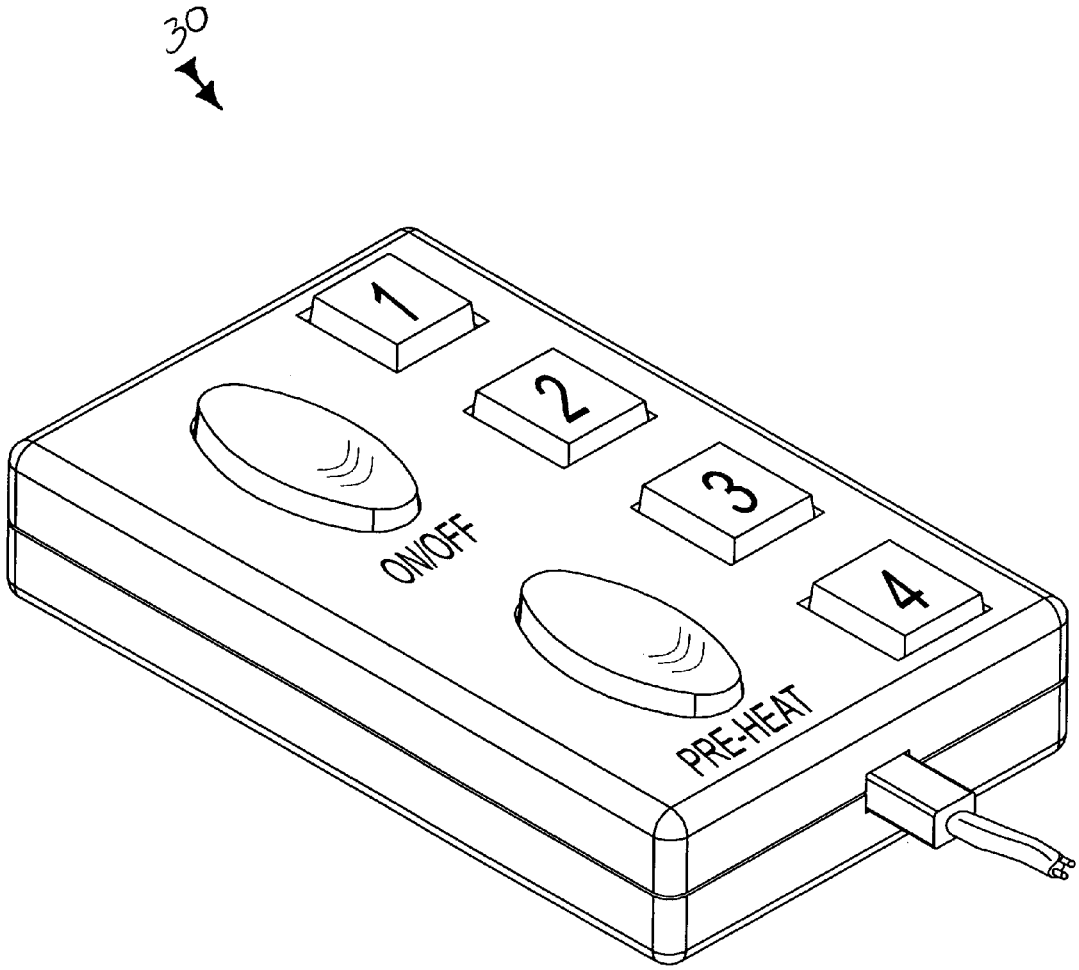
FIG. 4B is a perspective view of the alternate controller interface arrangement shown in FIGS. 4 and 4A.
Figure 7:
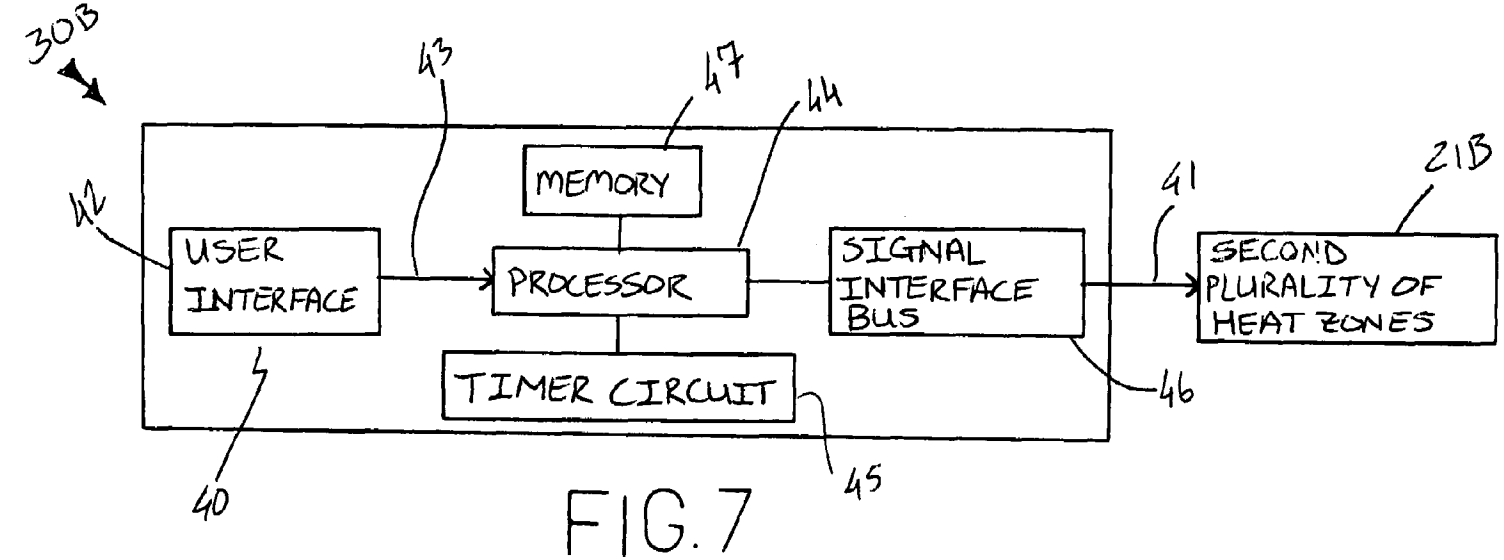
FIG. 7 is a schematic block diagram of the second controller shown in FIG. 5.

Referring to FIGS. 2A, 5 and 7, the multi-zone blanket 10 further includes a second external controller 30B that is electrically coupled to the AC/DC transformer 31 and receives the low input voltage 32B therefrom. Such a second external controller 30B includes a mechanism 40 for providing a plurality of output control signals 41 to the second plurality of heat zones 21B, which is vital such that each of the second plurality of heat zones 21B can advantageously simultaneously and independently generate a selected quantity of heat as desired by the user. Thus, not only can the second user alter the temperature from the temperature of a person next to them, but advantageously they can also alter the temperatures among each heat zone in their respective plurality of heat zones. Each of the first 21A and second 21B plurality of heat zones includes a plurality of auxiliary heating elements 23 that are electrically connected to a corresponding one of the primary heating elements 22. Each of the auxiliary heating elements 23 is connected in parallel to the corresponding primary heating elements 22 respectively.

Referring to FIGS. 2, 2A, 6 and 7, each of the output control signal providing mechanisms 40 for the first 21A and second 21B plurality of heat zones respectively include a user interface 42 for generating and transmitting an input control signal 43 based upon a user input. A processor 44 is electrically coupled to the user interface 42 and receives the input control signal 43 therefrom. A timer circuit 45 is electrically coupled to the processor 44. A signal interface bus 46 is electrically coupled to the processor 44 that is important for effectively distributing the output control signals 41 to corresponding ones of the first 21A and second 21B plurality of heat zones respectively. A memory 47 is electrically coupled to the processor 44. Such a memory 47 includes software instructions that effectively cause individual ones of the first 21A and second plurality 21B of heat zones to generate heat for a predetermined period of time and within a predetermined temperature range.

Figure 6:
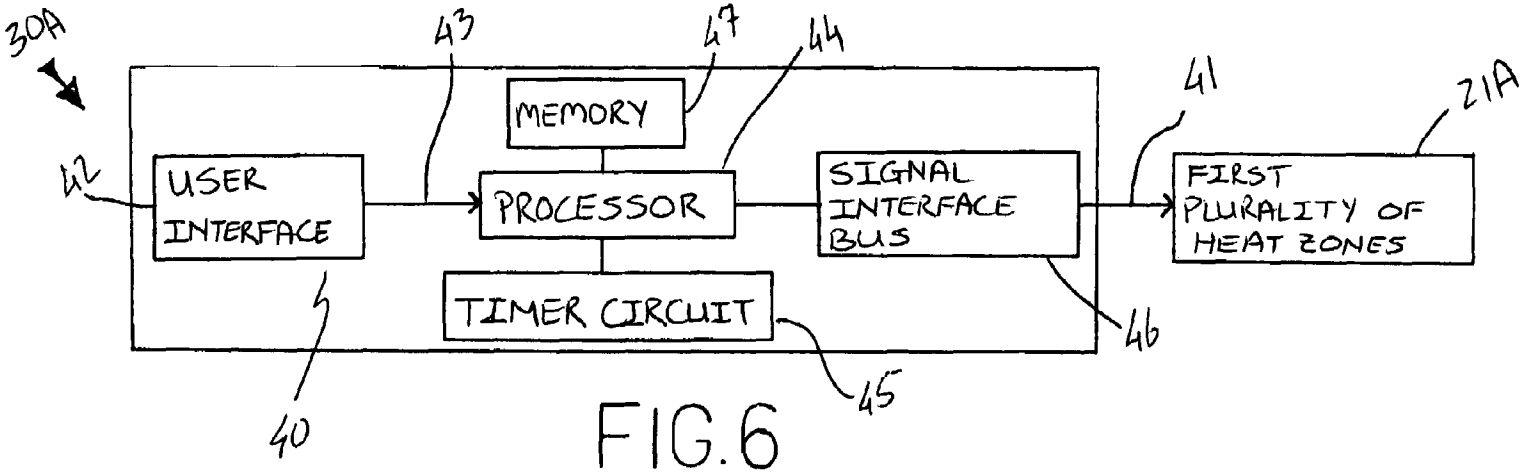
FIG. 6 is a schematic block diagram of the first controller shown in FIG. 5.

Referring to FIGS. 6 and 7, the software instructions execute a control algorithm that includes the steps of identifying a time data stream from the input control signal 43, identifying a temperature range data stream from the input control signal 43, identifying whether selected ones of the first 21A and second 21B plurality of heat zones are associated with the time and temperature data streams, and instructing the timer circuit 45 to generate and transmit a monitoring output signal to the signal interface bus 46 for effectively controlling distribution of the plurality of output control signals 41 to the corresponding ones of the first 21A and second 21B plurality of heat zones. Of course, as is shown in FIGS. 3, 3A, 3B, 4, 4A and 4B, in the event that additional heat zones 21 are added, as mentioned herein above, the interface 42 of controllers 30 may be appropriately altered for controlling a temperature of such additional heat zones 21, as is obvious to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-zone blanket for distributing alternate levels of heat for a user, said multi-zone blanket comprising:

a body comprising a first plurality of heat zones juxtaposed side-by-side within a cavity of said body;

a first primary heating element passing through each of said first plurality of heat zones;

a first external controller and an AC/DC transformer electrically coupled directly thereto, said first external controller further being electrically coupled to said first primary heating element, said transformer being removably coupled to an external power supply source which provides a high voltage input to said transformer, said transformer converting said high voltage input to a low voltage input in such a manner that said first external controller receives said low voltage input during operating conditions, said first external controller comprising means for providing a plurality of output control signals to said first plurality of heat zones such that each of said first plurality of heat zones can simultaneously and independently generate a selected quantity of heat as desired by the user;

wherein said multi-zone blanket further comprises:

a second external controller electrically coupled to said AC/DC transformer and receiving said low input voltage therefrom, said second external controller comprising means for providing a plurality of output control signals to said second plurality of heat zones such that each of said second plurality of heat zones can simultaneously and independently generate a selected quantity of heat as desired by the user;

wherein said each of said output control signal providing means for said first and second plurality of heat zones respectively comprises:

a user interface for generating and transmitting an input control signal based upon a user input;

a processor electrically coupled to said user interface and receiving said input control signal therefrom;

a timer circuit electrically coupled to said processor;

a signal interface bus electrically coupled to said processor for distributing said output control signals to corresponding ones of said first and second plurality of heat zones respectively;

a memory electrically coupled to said processor, said memory including software instructions that cause individual ones of said first and second plurality of heat zones to generate heat for a predetermined period of time and within a predetermined temperature range, said software instructions executing a control algorithm including the steps of a. identifying a time data stream from said input control signal, b. identifying a temperature range data stream from said input control signal, c. identifying whether selected one of said first and second plurality of heat zones are associated with said time and temperature data streams, and d. instructing said timer circuit to generate and transmit a monitoring output signal to said signal interface bus for controlling distribution of said plurality of output control signals to said corresponding ones of said first and second plurality of heat zones.

2. The device of claim 1, wherein said body further comprises:

a second plurality of heat zones juxtaposed adjacent to said first plurality of heat zones, said first and second plurality of heat zones being independently and simultaneously operable such that selected portions of said body can dissipate alternate heat levels.

3. The device of claim 2, wherein each of said first and second plurality of heat zones comprises:

a plurality of auxiliary heating elements electrically connected to a corresponding one of said primary heating elements, each of said auxiliary heating elements being connected in parallel to said corresponding primary heating elements respectively.

4. A multi-zone blanket for distributing alternate levels of heat for a user, said multi-zone blanket comprising:

a body comprising a first plurality of heat zones juxtaposed side-by-side within a cavity of said body, wherein said first plurality of heat zones are symmetrically aligned within said cavity of said body;

a first primary heating element passing through each of said first plurality of heat zones;

a first external controller and an AC/DC transformer electrically coupled directly thereto, said first external controller further being electrically coupled to said first primary heating element, said transformer being removably coupled to an external power supply source which provides a high voltage input to said transformer, said transformer converting said high voltage input to a low voltage input in such a manner that said first external controller receives said low voltage input during operating conditions, said first external controller comprising means for providing a plurality of output control signals to said first plurality of heat zones such that each of said first plurality of heat zones can simultaneously and independently generate a selected quantity of heat as desired by the user;

wherein said multi-zone blanket further comprises:

a second external controller electrically coupled to said AC/DC transformer and receiving said low input voltage therefrom, said second external controller comprising means for providing a plurality of output control signals to said second plurality of heat zones such that each of said second plurality of heat zones can simultaneously and independently generate a selected quantity of heat as desired by the user;

wherein said each of said output control signal providing means for said first and second plurality of heat zones respectively comprises:

a user interface for generating and transmitting an input control signal based upon a user input;

a processor electrically coupled to said user interface and receiving said input control signal therefrom;

a timer circuit electrically coupled to said processor;

a signal interface bus electrically coupled to said processor for distributing said output control signals to corresponding ones of said first and second plurality of heat zones respectively;

a memory electrically coupled to said processor, said memory including software instructions that cause individual ones of said first and second plurality of heat zones to generate heat for a predetermined period of time and within a predetermined temperature range, said software instructions executing a control algorithm including the steps of a. identifying a time data stream from said input control signal, b. identifying a temperature range data stream from said input control signal, c. identifying whether selected one of said first and second plurality of heat zones are associated with said time and temperature data streams, and d. instructing said timer circuit to generate and transmit a monitoring output signal to said signal interface bus for controlling distribution of said plurality of output control signals to said corresponding ones of said first and second plurality of heat zones.

5. The device of claim 4, wherein said body further comprises:

a second plurality of heat zones juxtaposed adjacent to said first plurality of heat zones, said first and second plurality of heat zones being independently and simultaneously operable such that selected portions of said body can dissipate alternate heat levels.

6. The device of claim 5, wherein each of said first and second plurality of heat zones comprises:

a plurality of auxiliary heating elements electrically connected to a corresponding one of said primary heating elements, each of said auxiliary heating elements being connected in parallel to said corresponding primary heating elements respectively.

7. A multi-zone blanket for distributing alternate levels of heat for a user, said multi-zone blanket comprising:

a body comprising a first plurality of heat zones juxtaposed side-by-side within a cavity of said body, wherein said first plurality of heat zones are symmetrically aligned within said cavity of said body;

a first primary heating element passing through each of said first plurality of heat zones;

a first external controller and an AC/DC transformer electrically coupled directly thereto, wherein said first external controller is removably attached to said first primary heating element, said first external controller further being electrically coupled to said first primary heating element, said transformer being removably coupled to an external power supply source which provides a high voltage input to said transformer, said transformer converting said high voltage input to a low voltage input in such a manner that said first external controller receives said low voltage input during operating conditions, said first external controller comprising means for providing a plurality of output control signals to said first plurality of heat zones such that each of said first plurality of heat zones can simultaneously and independently generate a selected quantity of heat as desired by the user;

wherein said multi-zone blanket further comprises:

a second external controller electrically coupled to said AC/DC transformer and receiving said low input voltage therefrom, said second external controller comprising means for providing a plurality of output control signals to said second plurality of heat zones such that each of said second plurality of heat zones can simultaneously and independently generate a selected quantity of heat as desired by the user;

wherein said each of said output control signal providing means for said first and second plurality of heat zones respectively comprises:

a user interface for generating and transmitting an input control signal based upon a user input;

a processor electrically coupled to said user interface and receiving said input control signal therefrom;

a timer circuit electrically coupled to said processor;

a signal interface bus electrically coupled to said processor for distributing said output control signals to corresponding ones of said first and second plurality of heat zones respectively;

a memory electrically coupled to said processor, said memory including software instructions that cause individual ones of said first and second plurality of heat zones to generate heat for a predetermined period of time and within a predetermined temperature range, said software instructions executing a control algorithm including the steps of a. identifying a time data stream from said input control signal, b. identifying a temperature range data stream from said input control signal, c. identifying whether selected one of said first and second plurality of heat zones are associated with said time and temperature data streams, and d. instructing said timer circuit to generate and transmit a monitoring output signal to said signal interface bus for controlling distribution of said plurality of output control signals to said corresponding ones of said first and second plurality of heat zones.

8. The device of claim 7, wherein said body further comprises:

a second plurality of heat zones juxtaposed adjacent to said first plurality of heat zones, said first and second plurality of heat zones being independently and simultaneously operable such that selected portions of said body can dissipate alternate heat levels.

9. The device of claim 8, wherein each of said first and second plurality of heat zones comprises:

a plurality of auxiliary heating elements electrically connected to a corresponding one of said primary heating elements, each of said auxiliary heating elements being connected in parallel to said corresponding primary heating elements respectively.

* * * * *